US010352046B2

(12) United States Patent
Prowse

(10) Patent No.: US 10,352,046 B2
(45) Date of Patent: Jul. 16, 2019

(54) ADJUSTABLE COMPACT LIFTING COUPLER AND METHOD OF USE

(71) Applicant: M3S HOLDINGS PTY LTD, Toowoomba, Queensland (AU)

(72) Inventor: Steven Prowse, Toowoomba (AU)

(73) Assignee: M3S HOLDINGS PTY LTD, Toowoomba, Queensland (AU)

( * ) Notice: Subject to any disclaimer, the term of this patent is extended or adjusted under 35 U.S.C. 154(b) by 0 days.

(21) Appl. No.: 15/556,684

(22) PCT Filed: Apr. 21, 2017

(86) PCT No.: PCT/AU2017/050366

§ 371 (c)(1),
(2) Date: Sep. 8, 2017

(87) PCT Pub. No.: WO2017/181244

PCT Pub. Date: Oct. 26, 2017

(65) Prior Publication Data

US 2018/0187418 A1 Jul. 5, 2018

(30) Foreign Application Priority Data

Apr. 22, 2016 (AU) ..... 2016901510

(51) Int. Cl.
*E04C 5/16* (2006.01)
*E04B 1/21* (2006.01)

(52) U.S. Cl.
CPC ..... *E04C 5/165* (2013.01); *E04B 1/215* (2013.01)

(58) Field of Classification Search
CPC . E04C 5/165; E04C 5/18; E04B 1/215; E04G 21/142; B66C 1/666; Y10T 403/29; Y10T 403/291; Y10T 403/299; Y10T 403/551; Y10T 403/556; Y10T 403/67; Y10T 403/66

(Continued)

(56) References Cited

U.S. PATENT DOCUMENTS 3,965,627 A * 6/1976 Fencl ..... E04B 1/34823 52/79.13
5,305,573 A * 4/1994 Baumann ..... E04C 5/165 403/305

(Continued)

*Primary Examiner* — Brian E Glessner
*Assistant Examiner* — Adam G Barlow
(74) *Attorney, Agent, or Firm* — Mattingly & Malur, PC

(57) ABSTRACT

A self-centring compact coupler for lifting, jacking or pushing apart and positioning concrete elements via their reinforcement bars (rebar) having an adjusting coupler member screwed on a threaded post attached to one rebar to apply a lifting or pushing force against a non-adjustable seating stud with an integral seating head and centring protrusion fixed to a corresponding and opposite rebar. An enclosing coupler member is screwed on the adjusting coupler member to enclose and lock the seating head and couple the rebar. The unitary configuration of the seating stud and seating head reduces the number of parts. The centring facility negates need of large internal tolerances to accommodate rebar misalignment, thus substantially ensuring co axial transfer of force from the coupler to the rebar. The coupler is used to incrementally vary and accurately adjust the relative positions of the concrete elements to one another in the building process.

19 Claims, 7 Drawing Sheets

(58) Field of Classification Search
USPC ..... 52/125.2–125.5, 127.12, 583.1, 707; 411/87, 204, 222, 223, 383, 384, 388, 411/395, 427
See application file for complete search history.

(56) References Cited

U.S. PATENT DOCUMENTS 6,065,263 A * 5/2000 Taguchi ..... E04B 5/023 403/305
8,505,879 B2 * 8/2013 Ruan ..... B25B 13/48 254/232
9,062,457 B2 * 6/2015 Gilling ..... E04C 5/165
9,377,047 B2 * 6/2016 Hill ..... F16B 21/00
10,041,252 B1 * 8/2018 Bongiorno ..... E04C 5/165
2002/0157333 A1 * 10/2002 Kadotani ..... E04C 5/08 52/223.2
2005/0023831 A1 * 2/2005 Hughes ..... E21B 17/028 285/330
2005/0180813 A1 * 8/2005 Van De Riet ..... E04C 5/165 403/307
2006/0053735 A1 * 3/2006 Kim ..... E04C 5/163 52/848
2007/0175167 A1 * 8/2007 Allen ..... E04C 5/165 403/307
2013/0230350 A1 * 9/2013 Kim ..... E04C 5/165 403/327
2015/0037090 A1 * 2/2015 Wakiyama ..... E04C 5/165 403/343
2015/0292207 A1 * 10/2015 Prowse ..... E04C 5/165 52/707
2016/0208492 A1 * 7/2016 Kim ..... E04C 5/165
2017/0081853 A1 * 3/2017 Kim ..... E04G 21/12
2018/0187418 A1 * 7/2018 Prowse ..... E04C 5/165

* cited by examiner

ADJUSTABLE COMPACT LIFTING COUPLER AND METHOD OF USE

It is intended that the disclosure in Australian Provisional Application No.2016901510 be incorporated by reference in this and any national application for Letters Patent.

FIELD OF THE INVENTION

This invention concerns a novel and improved compact self-centring rebar coupler for screw jacking, lifting or pushing apart, concrete structures via their opposing reinforcement bars (rebar) during the construction of a building. Specifically, the coupler includes as an essential integer, a one-piece and non-rotating (non-adjustable) seating stud comprising an integral self-centring head of unitary construction specially adapted to engage a rotatable and adjusting coupler member. The unitary configuration of the seating stud and seating head significantly reduces the number of parts with any attendant possibility of their individual failure. The seating stud's centring ability negates need of large internal tolerances to accommodate misalignment of opposed rebar thus ensuring substantial co axial transfer of force from the coupler to the rebar. Moreover, the coupler's economy of components and limitation to a sole adjustable member is a significant improvement over the prior art as it eliminates or minimises any internal elongation or inherent total slippage. Importantly, this factor enables the coupler to meet the stringent tolerance compliance and safety requirements currently mandated by local and international standards.

BACKGROUND OF THE INVENTION

While methods of coupling reinforcing bar (rebar) are well known in the building industry, solutions to problems associated with accurately positioning pre-cast concrete structures prior to joining rebar, have not to date, enjoyed similar progress. In almost all situations, the prior art solution is commonly dependent on first locating and independently supporting the concrete structures with respect to each other by cranes or props. This then is followed by the connection of associated reinforcement bars or rods protruding from the respective concrete structures. Invariably, the bars are often not perfectly aligned as a result of when the bars were initially cast in the concrete structures themselves.

Prior art rebar connection means are as varied as the building construction. A common method of connecting the bars is by overlapping and tie wiring them together with a stipulated overlap length of normally thirty to forty times individual bar diameter. While this method does not require overlapping bars to be accurately and co axially aligned, a plurality of them can create congestion within the confines of the limited construction space. This invariably results in the concrete elements having to be larger simply to accommodate the greater space occupied by the number of overlapping and wire tied bars. While this method is common practice for in-situ cast structures, it becomes even more complicated when the opposing structural elements are precast away from the building, for example, at a remote factory location. In that case, at least one concrete element would need to have voids cast into it to accommodate the extra space required by the overlapping procedure. The voids also need to be big enough to allow for any misalignment of the bars which are then grout or epoxy filled in order to permanently intergrate the connection. The concrete elements need to be propped or braced until the supporting concrete structure cures and must be safely secured during the entire building procedure. As a consequence, there is an unavoidable degree of complexity and material wastage associated with this method which is not only expensive but is also time and labour intensive. Another method of joining reinforcement bars utilises mechanical device connectors which are threaded or attached by an epoxy adhesive adapted to join the ends of the rebar. The use of mechanical connectors however invariably requires the bars to be very closely or near perfectly aligned. Moreover, this method is usually satisfactory if there is only a single bar to be joined to an opposite bar. Australian Patent 2003210074 and WO98/44215 (Barfix Bermuda Ltd) describe a method and device for joining steel bars involving a connecting element with a thread cutter to cut a conical screw at one end of a reinforcement bar.

AU2001051968 discloses a structural bracing system involving a lockable nut used with a threaded steel bar which includes a locking member engaged with the bar. The locking member has a finger to engage the locking nut with the end of the finger being displaced as a result of the deformation of a finger actuated tab.

In all of the above prior art, the methods and apparatus for connecting reinforcing bars are reliant on their perfect or near perfect alignment with their opposite numbers. In most situations, there are often multiple bars which are required to be connected as a group. Needless to say, it is a highly skilled and labour intensive task to ensure that all bars of one group are accurately aligned with the corresponding bars of an opposite group.

Significantly, nothing in the preceding examples however provides for the ability to selectively lift or push apart strategically selected opposing bars to adjust the positions of the associated concrete structures. While previously mentioned, in almost all situations where stacked or vertically aligned concrete structures are involved, the solution is commonly to locate and support the structures temporarily with props or other means prior to actually joining them together. This procedure is complicated and multi-stepped and often results in reinforcement bars becoming no longer aligned and ultimately too difficult to successfully connect.

A recent solution to this problem has been the development of a combination coupler and column alignment device disclosed in WO 2014/000038. This coupler utilises an adjustment nut screwed on a threaded rebar stud. In use, the adjustment nut is forcibly jacked against washers functioning as bearing surfaces of a coupler member screwed on an opposing rebar stud. An important consideration with this coupler, as with all the previous examples, is the need to align or centre the rebar prior to actually joining them together. Like the other prior art couplers, this coupler relies on generous internal diameters to accommodate misalignment of the rebar. Furthermore, this coupler utilises multiple threaded and non-threaded components to affect the transfer of forces to the rebar. The problem with the addition of each separate component, is that the total risk of potential failure is correspondingly also increased. When the coupler is safety tested, the total inherent slippage or elongation dramatically rises with each threaded component. This can result in the devices ultimately failing or not meeting the relevant engineering and safety standards. Although one solution is to increase the size of various components (in the attempt to reduce the total slippage or elongation), large couplers can make them difficult or impossible to use in the limited spaces normally afforded between the concrete elements to be joined. In addition, larger sized couplers not only use more steel but can require more time and labour to manufacture and/or assemble.

It is thus a general object of the present invention to ameliorate or eliminate some if not all of the problems and disadvantages associated with the prior art. In the least, it seeks to provide the public with an alternative commercially useful choice. As the invention is specifically directed to the removal of external supports normally used to position concrete structures during construction, the principle object is thus to provide a compact, self-centring and lifting coupler with a substantially reduced number of parts (e.g. adjustment nuts) and bearing surfaces (e.g. washers), thereby reducing total inherent slippage or elongation to comply with the most demanding of industrial safety standards.

STATEMENT OF INVENTION

In one aspect the invention resides in a compact, self-centring, jacking and positioning coupler for lifting or pushing apart and supporting adjoining concrete structures via their reinforcement bars (rebar) during construction comprising:

- a threaded post to be attached to a rebar of a first concrete structure;
- a one-piece, non-rotating seating stud comprising a shank including an integral seating head with a centring protrusion, the seating stud adapted to be fixed to a corresponding opposite rebar of a second concrete structure;
- an adjusting coupler member having an inner threaded and an outer threaded wall and an end wall, the end wall complementarily configured to receive the centring protrusion;
- the adjusting coupler member adapted to be screwed onto the threaded post and rotated against the fixed seating stud, wherein the end wall on engaging the protrusion, centres and co axially aligns the opposing rebar within a pre-determined tolerance for mis-alignment;
- an enclosing coupler member having an inner threaded wall and an end wall aperture;
- the enclosing coupler member adapted to be screwed onto the adjusting coupler member with the shank of the seating stud passing through the aperture;
- the adjusting coupler member screwed on the threaded post to engage and apply a lifting or pushing force against the seating head, wherein the position of the first to the second concrete element can be incrementally and accurately adjusted, and wherein on achieving the desired final position, the enclosing coupler member is screwed onto the adjusting coupler member to enclose and lock the seating head against the adjusting coupler member thereby also coupling the rebar.

Preferably, the seating stud, shank and seating head with the centring protrusion is of a unitary or one piece construction.

Preferably, the centring protrusion is of a conical, frusta conical or tapered configuration.

The end wall of the adjusting coupler adapted to receive the protrusion comprises a female indentation of a complementary configuration to that of the male protrusion wherein on engaging the protrusion, axially centres the opposing rebar within a pre-determined tolerance for mis-alignment.

Preferably, the threaded post and the seating stud are permanently attached to the opposing protruding rebar, respectively by friction welds.

In the alternative, the threaded post and the seating stud are attached to the opposing rebar, respectively by internally threaded sockets welded to the rebar.

Preferably, both the adjusting and enclosing coupler members have external machined facets or flats for the application of a spanner to tighten the coupler members together.

Preferably, the seating head of the seating stud comprises a cylindrical boss; the cylindrical boss including a conical protrusion centrally located at the centre of its upper surface.

Preferably, the shank of the seating stud has a neck of a reduced size between the seating head to provide increased sideways movement or lateral tolerance when in the aperture of the enclosing coupler member.

In a preferred example, the shank of the seating stud and enclosing coupler have complementary threaded portions to temporarily hold the enclosing coupler out of the way while the adjusting coupler engages the seating head prior to achieving the desired final position and the enclosing coupler member is screwed onto the adjusting coupler member to couple the rebar.

The complementary threaded portions are preferably relatively shallow in comprising only a few threads due to their temporary function or utility.

The conical centring protrusion located on the top of the seating head, is adapted to assist in the alignment of the adjusting coupler member when the seating head and the adjusting coupler member are brought into contact. The diameter at the base of this protrusion is smaller than the internal diameter of the adjusting coupler to allow for any lateral misalignment of the opposing rebar. This protrusion is also a safety feature as it prevents the adjusting coupler member slipping off the seating head during the building and construction process.

Preferably, the end wall of the adjusting coupler adapted to receive the protrusion comprises an indentation or aperture of a larger size than the protrusion wherein on fully engaging the protrusion there is a gap between the protrusion and the indentation or aperture of at least three millimetres in width. In the alternative, the gap can be less than three millimetres in width.

Preferably, the threaded post has an enlarged, un-threaded portion at an end not attached to a rebar as a safety feature to prevent the adjusting coupler member from being wound past its threaded engagement with the threaded post.

Preferably, the threaded post also has a conical indentation or aperture at its enlarged, un-threaded end to allow the conical centring protrusion more vertical adjustment space within the coupler when there is a need to confine the overall length of the coupler assembly to accommodate a narrower space between the two concrete structural elements being lifted or jacked and vertically aligned into position.

Preferably, there is a lock nut on the threaded post which can be tightened down against the adjusting coupler member to further secure the completed coupler assembly and reduce the overall slip or elongation of the coupler assembly when it is placed under tensile or compressive load.

The coupler can also be modified for use as a tensioning coupler, the modifications including:

- the adjusting coupler member lengthened to provide additional threads on its inner and outer walls;
- the enclosing coupler member lengthened to provide additional thread on its inner wall;
- wherein on assembly, the elongated threaded walls of both coupler members enables
- the end wall of the enclosing coupler member to engage the seating head before the adjusting coupler member contacts the seating head, and wherein continued screwing together of the adjusting and enclosing coupler members draws together the opposing rebar under tension.

Preferably, should the modified coupler be required to act in both tension and compression, a flowable, hard-setting filler, such as a cementitious grout or epoxy or similar material, can be injected into an internal void formed on screwing together the adjusting and enclosing coupler members.

Preferably, the filler can be injected through a feed-hole in the adjusting coupler member.

Preferably, there is also a bleed hole positioned in the adjusting coupler member to allow air to escape as the filler is injected in to the void.

Preferably, both the feed hole and the bleed hole are internally threaded to allow a threaded bung to be inserted to prevent any loss of the filler after it has been injected into the void.

More preferably, the internally threaded feed hole may also be used to secure a threaded end of an injection apparatus when injecting the filler.

Suitably, after the filler has set to a required strength, the modified version of the coupler assembly will perform equally in accommodating both compressive and tensile forces.

In another aspect, the invention resides in a method of adjusting the position of concrete building structures located above one another through their reinforcement bars or studs using the coupler as claimed in claim 1 including the steps of:

a) attaching the threaded posts with adjusting coupler members screwed on, to the rebar of the first concrete element;
b) attaching the seating studs passed through the enclosing coupler members to the corresponding opposite rebar of a second concrete element;
c) screwing the enclosing coupler members onto the complementary threaded portions of the seating studs to temporarily hold the enclosing coupler members out of the way;
d) screwing the adjusting coupler members on the posts to engage the seating heads to co axially align and apply a lifting or pushing force to adjust the position of the first and second concrete elements with respect to one another;
e) on completion of adjustment, screwing the enclosing coupler members on the adjusting coupler members to enclose and lock the seating heads and couple the rebar;
f) tightening any lock nuts to further secure individual components of the coupler assemblies;
g) optionally filling any voids in the coupler assemblies with filler, before
h) permanently embedding the coupler assemblies in concrete.

BRIEF DESCRIPTION OF THE DRAWINGS

In order for the invention to be better understood and put into practical effect reference will now be made to the accompanying drawings, wherein.

DETAILED DESCRIPTION OF THE DRAWINGS

Figure 1:
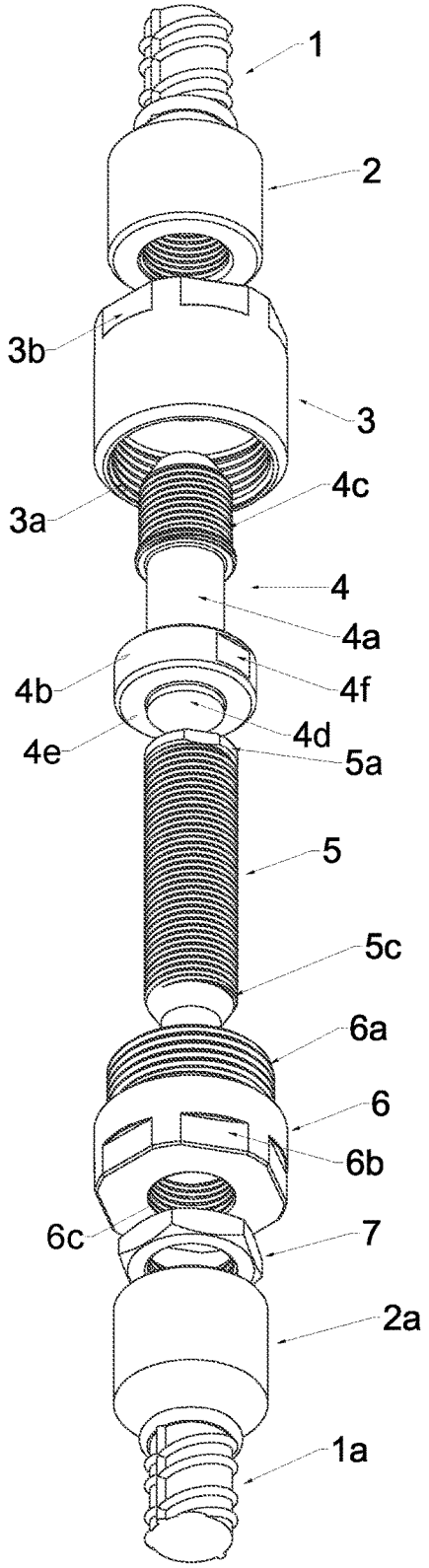
FIG. 1 shows an exploded view of a preferred coupler of the invention.

FIG. 1 is an exploded view of the adjustable coupler assembly joined to typical reinforcement bars 1, 1*a* used in reinforced concrete structural elements (not shown).

Internally threaded sockets 2, 2*a* are preferably friction welded or attached by other mechanical means to reinforcement bars 1, 1*a* enclosing coupler member 3 includes an internal threaded wall 3*a* for engagement with outer threaded wall 6*a* of adjusting coupler member 6. There is an aperture or hole (obscured in this view) in the end wall of enclosing coupler member 3 through which shaft 4*a* of seating stud 4 passes. Preferably, facets or flats 3*b*, 6*b* are machined on the external surfaces of the adjusting coupler member 6 and enclosing coupler member 3 for the application of one or more spanners (not shown) to tighten the assembly together. Seating stud 4 with shaft 4*a* has a threaded end 4*c* for engagement into internally threaded socket 2. On the opposite end, there is a seating head 4*b* (referred also as 4*b* in FIGS. 3 and 4) against which the adjusting coupler member 6 engages to apply the lifting or jacking force. Located on the bearing surface 4*e* of the seating head 4*b*, a tapered or conical centring protrusion 4*d* (referred also as 4*d* in FIGS. 3 and 4) assists the alignment of adjusting coupler member 6 as the seating stud 4 and adjusting coupler member 6 are brought into contact. The diameter of the base of the tapered or conical protrusion is smaller, preferably at least three (3) millimetres or less, than the internal diameter of the adjusting coupler member 6 to allow for any lateral misalignment of the lower and upper reinforcement bars 1, 1*a*. The tapered or conical protrusion is also a safety feature to prevent the seating stud 4 accidently slipping off adjusting coupler member 6 during the building alignment or erection process. The shank 4*a* is preferably narrower than or of reduced size (shown between the seating head 4*b* and the threaded portion 4*c*) to provide increased lateral movement or sideways tolerance when in aperture 3*a* in the aperture 3*a* of enclosing coupler member 3 (refer also 8 and 8*a* in FIGS. 9 and 10). Seating stud 4 also may have flats 4*f* machined on the seating head 4*b* for the application of a spanner (not shown) for tightening the seating head 4 into the internally threaded socket 2.

Threaded post 5 engages opposing reinforcement bar 1*a* via internally threaded socket 2*a* that is friction welded or attached by other mechanical means to reinforcement bar 1*a*. Opposite end 5*c* engages with socket 2*a*. Threaded post 5 has un-threaded end 5*a* (also referred as 5*a* in FIGS. 6 and 7) which is preferably also enlarged as a safety feature that prevents adjusting coupler member 6 from being wound past the desired thread engagement portion of post 5 (see also 6*c* in FIGS. 6 and 7). Threaded post 5 also has a conical indentation at the end (obscured in this view—see 5*b* in FIGS. 3, 4, 6 and 7) that accommodates the conical or tapered protrusion 4*d* (refer also 4*d* in FIGS. 3 and 4) on bearing surface 4*e* of seating head 4*b*. Conical indentation 5*b* allows for a greater and closer vertical adjustment by the coupler assembly if there is a need to reduce the overall length of the coupler assembly to accommodate very narrow spaces between concrete structures being aligned and joined.

Adjusting coupler member 6 has an external thread 6*a* for engagement with internal thread 3*a* of enclosing coupler member 3 and internal threaded wall 6*c* (referred also as 6*c* in FIGS. 6 and 7) for engagement with threaded post 5. Adjusting coupler member 6 also has flats 6*b* machined on the external face for the application of a spanner (not shown) to tighten together the coupler members during assembly.

Lock nut 7 on threaded post 5 is tightened against adjusting coupler member 6 when the coupler has been fully assembled.

Figure 2:
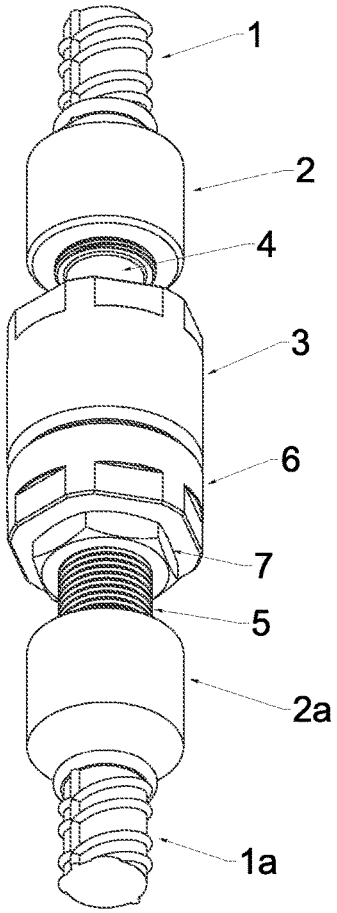
FIG. 2 shows a fully assembled view of the coupler of FIG. 1.

FIG. 2 is numbered substantially identically and is a view of the adjustable coupler of FIG. 1 when fully assembled.

Figures 3, 4, 5:
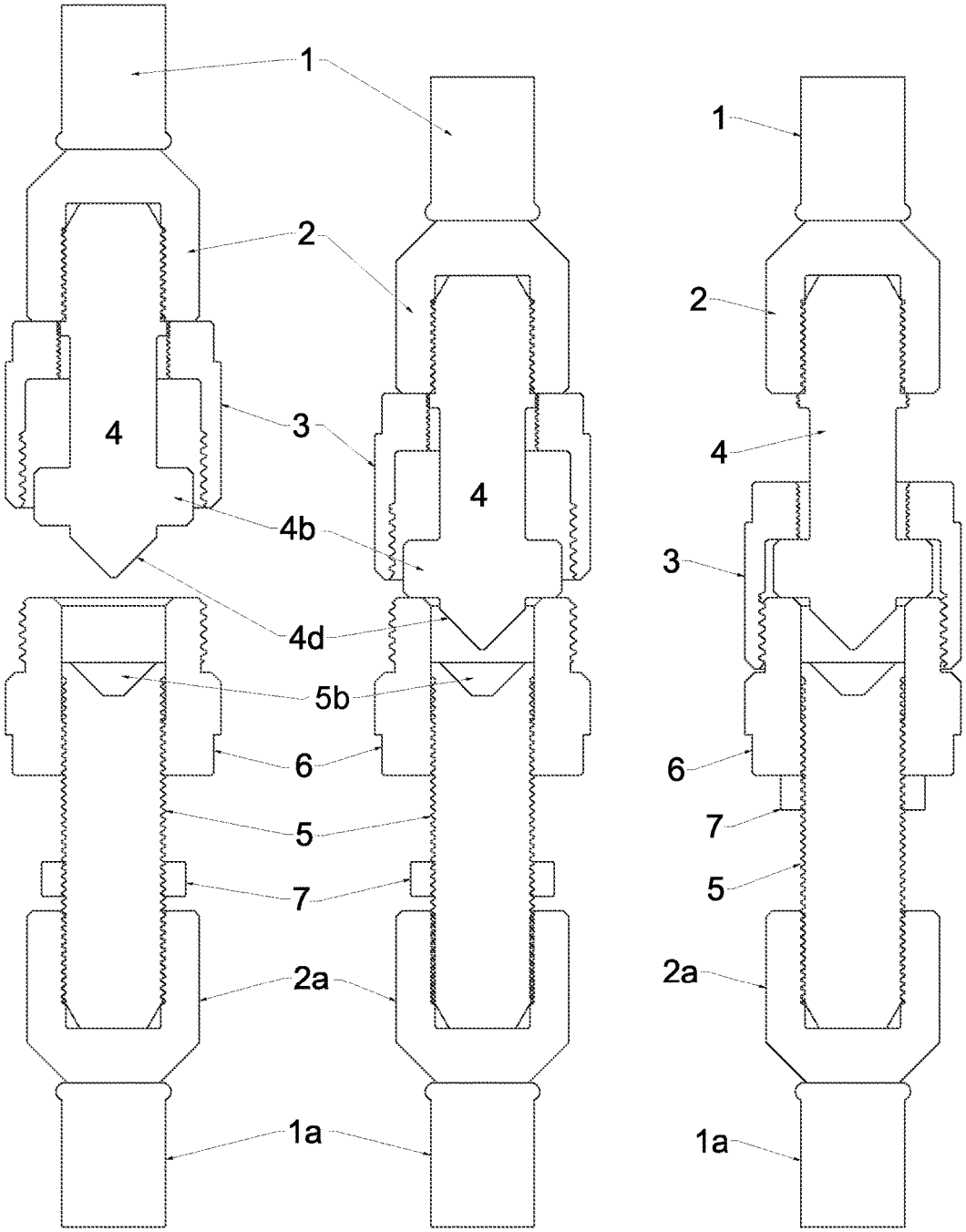
FIGS. 3, 4 and 5 show cross sections of the coupler in an assembly process when bringing two concrete structural elements together.

FIGS. 3, 4 and 5 show the assembly process when joining concrete structures together.

In FIG. 3, seating stud 4 with enclosing coupler member 3 are attached to internally threaded socket 2. Socket 2 is connected to the reinforcing steel bar 1 cast in an above positioned concrete structural element (not shown). Adjusting coupler member 6 and lock nut 7 are attached to socket 2*a* through threaded post 5. Socket 2*a* is connected to reinforcing steel bar 1*a* cast in a below positioned concrete structural element (not shown). The coupler is in this position just prior to the two concrete structural elements being brought together for joining and aligning.

In FIG. 4, the concrete structural elements (not shown) have been brought into position wherein adjusting coupler member 6 engages seating head 4*b*. Tapered centring protrusion 4*d* aligns with adjusting coupler member 6 as it is brought down until the seating head 4*b* makes contact with adjustable coupler 6 and also prevents seating stud 4 from slipping off adjusting coupler member 6.

FIG. 5 shows the coupler fully assembled wherein enclosing coupler member 3 is screwed onto adjusting coupler member 6 locking it against seating head 4*b*. This is then further secured by tightening lock nut 7 against adjusting coupler member 6.

Figure 6:
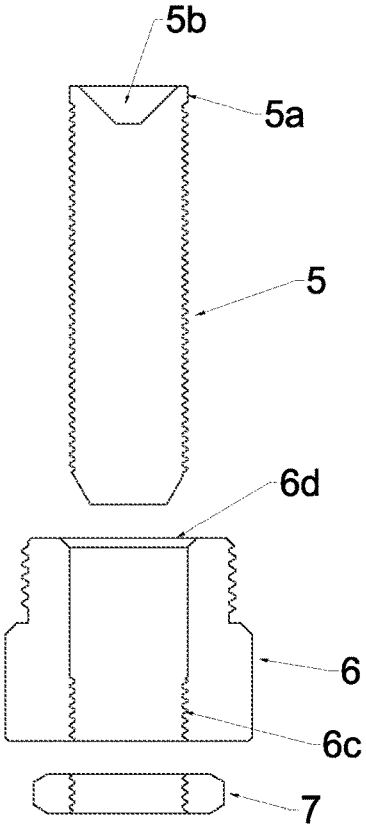
FIGS. 6 and 7 show a cross section of an assembly arrangement between an adjusting coupler member, a threaded post and a lock nut of the coupler.
Figure 7:
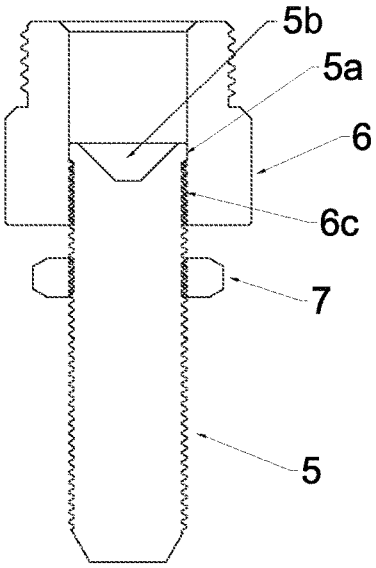

FIGS. 6 and 7 show the assembly arrangement between adjusting coupler member 6, threaded post 5 and lock nut 7. Specifically, FIG. 6 shows an exploded view of the three components wherein threaded post 5 is wound through threaded inner wall 6*c* of adjusting coupler member 6 by feeding it through open end 6*d* of adjusting coupler member 6. In FIG. 7, at the end of threaded post 5, an enlarged, un-threaded portion 5*a* will prevent adjusting coupler member 6 from being wound past the desired threaded engagement of threaded wall 6*c* (referred also as 6*c* in FIGS. 6 and 7) of adjusting coupler member 6. This is a very important safety feature when erecting concrete structures on site because in its absence, one cannot be sure if the adjusting coupler member has been wound down so far as to cause it to become disengaged from the threaded post or if it is merely engaged by only a few threads. The enlarged, un-threaded portion 5*a* thus ensures that threaded post 5 will always engage adjusting coupler member 6 by an appropriate or desired degree of threaded contact. In the interest of a clearer explanation of this feature, FIG. 7 shows adjusting coupler member 6 at its fully extended lifting position with enlarged, un-threaded portion 5*a* of threaded post 5 preventing adjusting coupler member 6 from being wound past minimum threaded contact 6*c* (referred also as 6*c* in FIGS. 6 and 7).

Figure 8:
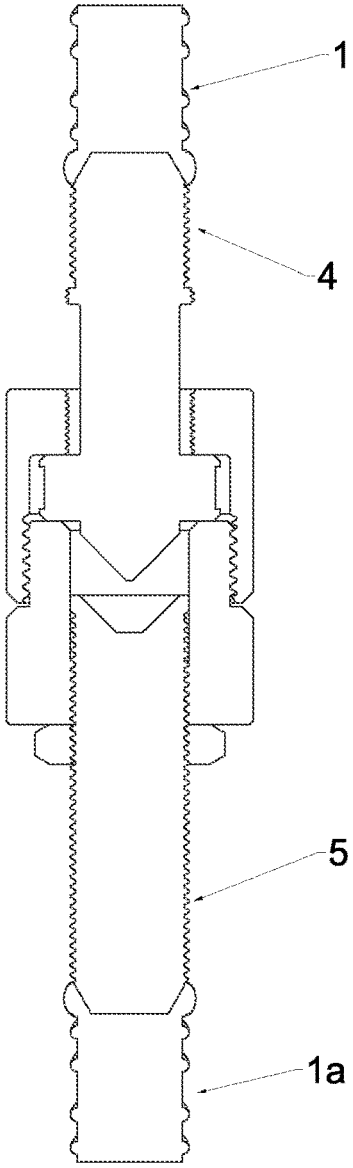
FIG. 8 shows a cross section of a coupler assembly wherein a threaded post and a seating stud are attached directly to reinforcing bars.

FIG. 8 shows threaded post 5 friction welded (or attached by other suitable mechanical means) directly to reinforcing bar 1*a* thereby negating the need for an internally threaded socket. Similarly, the seating stud 4 can be friction welded (or attached by other mechanical means) directly to reinforcing bar 1 also negating need for a threaded end and an internally threaded socket.

Figures 9, 10:
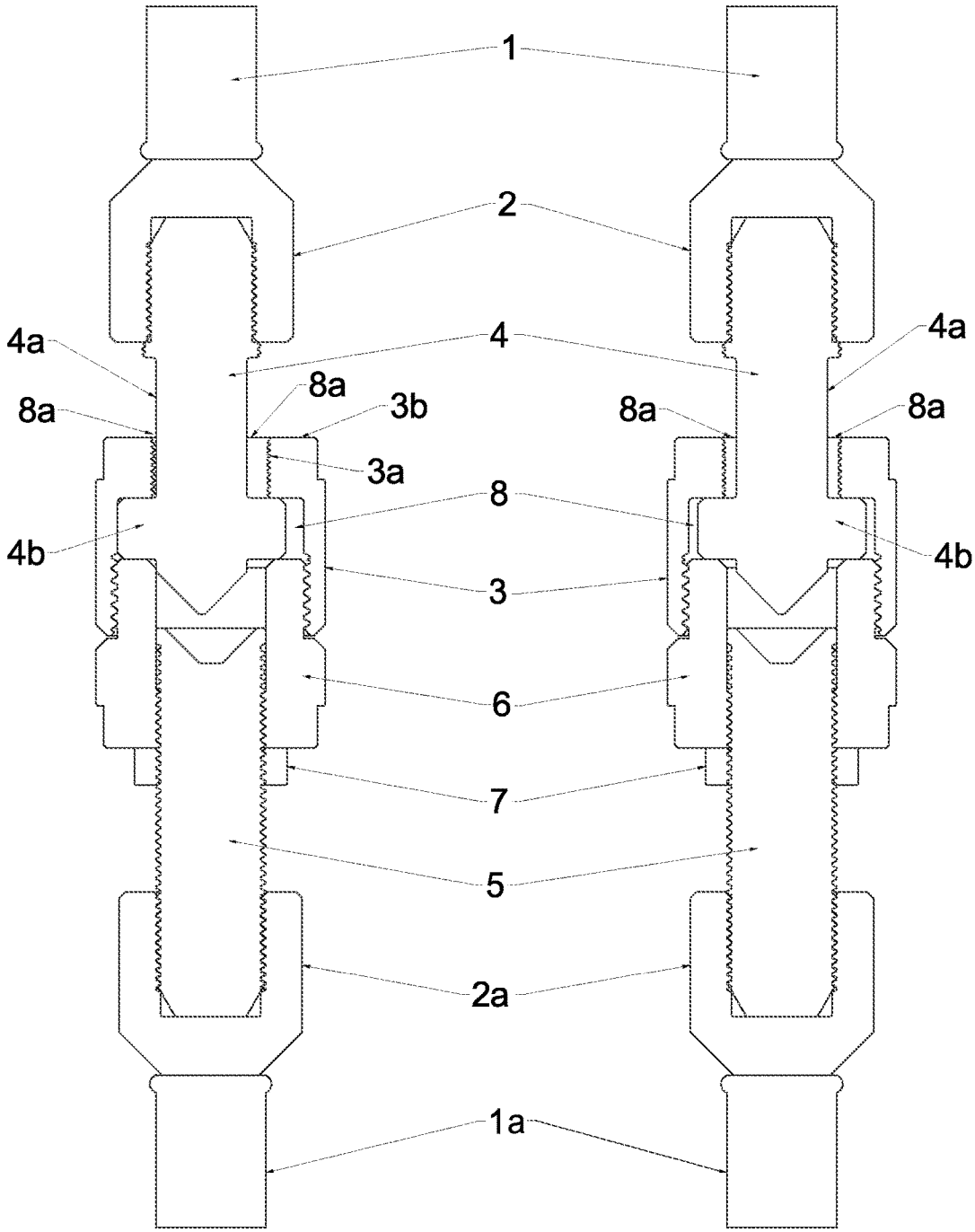
FIG. 9 shows a cross section of the coupler with the seating stud in an eccentric position within the enclosing coupler member when the opposing bars being connected are misaligned.
FIG. 10 shows a cross section of the coupler with the seating stud in a concentric position within the enclosing coupler member when the opposing bars being connected are aligned.

FIGS. 9 and 10 demonstrate the lateral or sideways tolerance achieved by aperture 3*a* in the base of enclosing coupler member 3 being larger than the narrower or necked portion of shank 4*a* of seating stud 4, while not being too large as to allow seating head 4*b* to be able to pass through. The spatial tolerance 8 and 8*a* provided enables accommodation of any slight misalignment of opposing rebar 1, 1*a* being coupled or joined.

FIG. 9 shows the reinforcing bars 1, 1*a* in a slightly eccentric or misaligned position whereas FIG. 10 shows the reinforcing bars 1, 1*a* in a near perfect aligned position.

Figure 11:
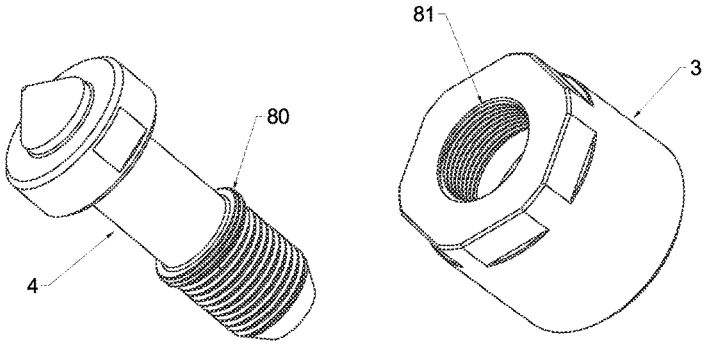
FIG. 11 shows details of the seating stud and the enclosing coupler member with complimentary threaded portions to hold the enclosing coupler member out of the way during the installation process.
Figure 13:
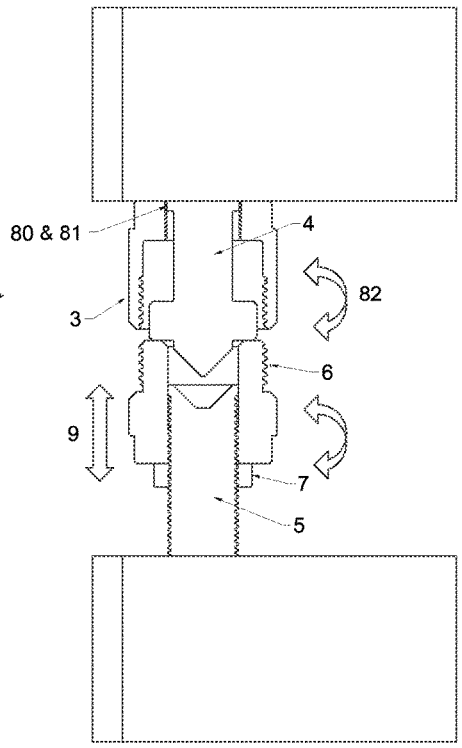

FIG. 11 shows seating stud 4 and enclosing coupler member 3 with complimentary threaded portions 80 and 81 (referred also as 80 and 81 in FIG. 13). These threaded portions allow enclosing coupler member 3 to be held up out of the way during the erection process (see also 80 and 81 in FIG. 13).

Figure 12:
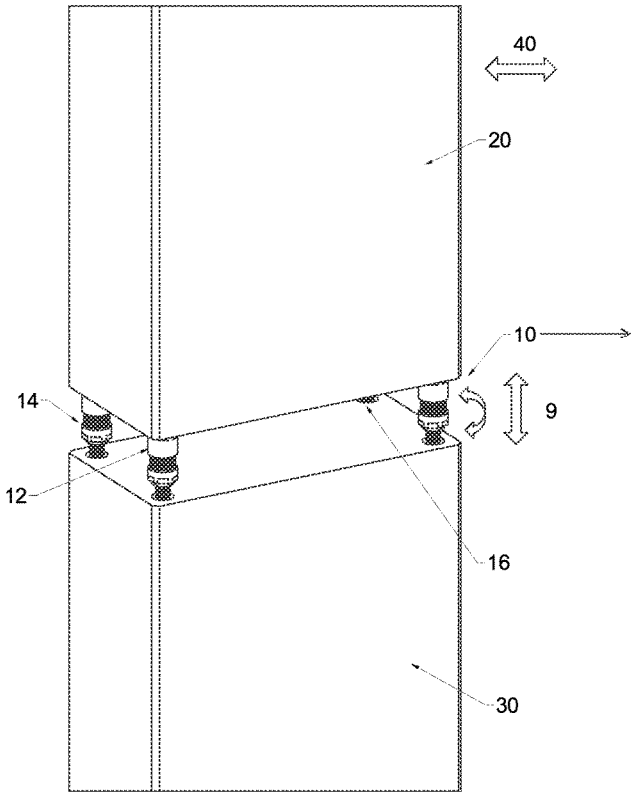
FIGS. 12 and 13 show the coupler in use when connecting and aligning precast concrete columns.

FIGS. 12 and 13 show adjustable coupler assemblies 10,12,14,16 (coupler assembly 16 slightly obscured in this view) in use connecting and aligning two concrete structural elements, in this case, concrete columns 20 and 30. FIG. 13 is a cutaway view of one of the adjustable coupler assemblies 10 located at the base of the concrete column 20 in FIG. 12. Rotating the adjusting coupler member 6 about threaded post 5 in either a clockwise or counter clockwise direction 9 against the seating head 4*b*, will either increase or decrease the distance between the two columns. In doing so, this will adjust the verticality of column 20 by incrementally adjusting the vertical position of column 20 to bring it into a desired vertical alignment with respect to column 30. FIG. 13 also shows enclosing coupler member 3 being held up out of the way on seating stud 4 by way of the complimentary threaded portions 80 and 81 located on seating stud 4 and enclosing coupler member 6 respectively. After the required coupler adjustment has been achieved, enclosing coupler member 3 can be released by screwing it off the complimentary threaded portion 80 located on seating stud 4, thereby allowing it to be engaged with adjusting coupler member 6 in order to complete the coupling process. After each of the coupler assemblies 10-16 have been finally adjusted and secured in position, the space between the two concrete columns 20, 30 can be filled in-situ with concrete.

Figure 14:
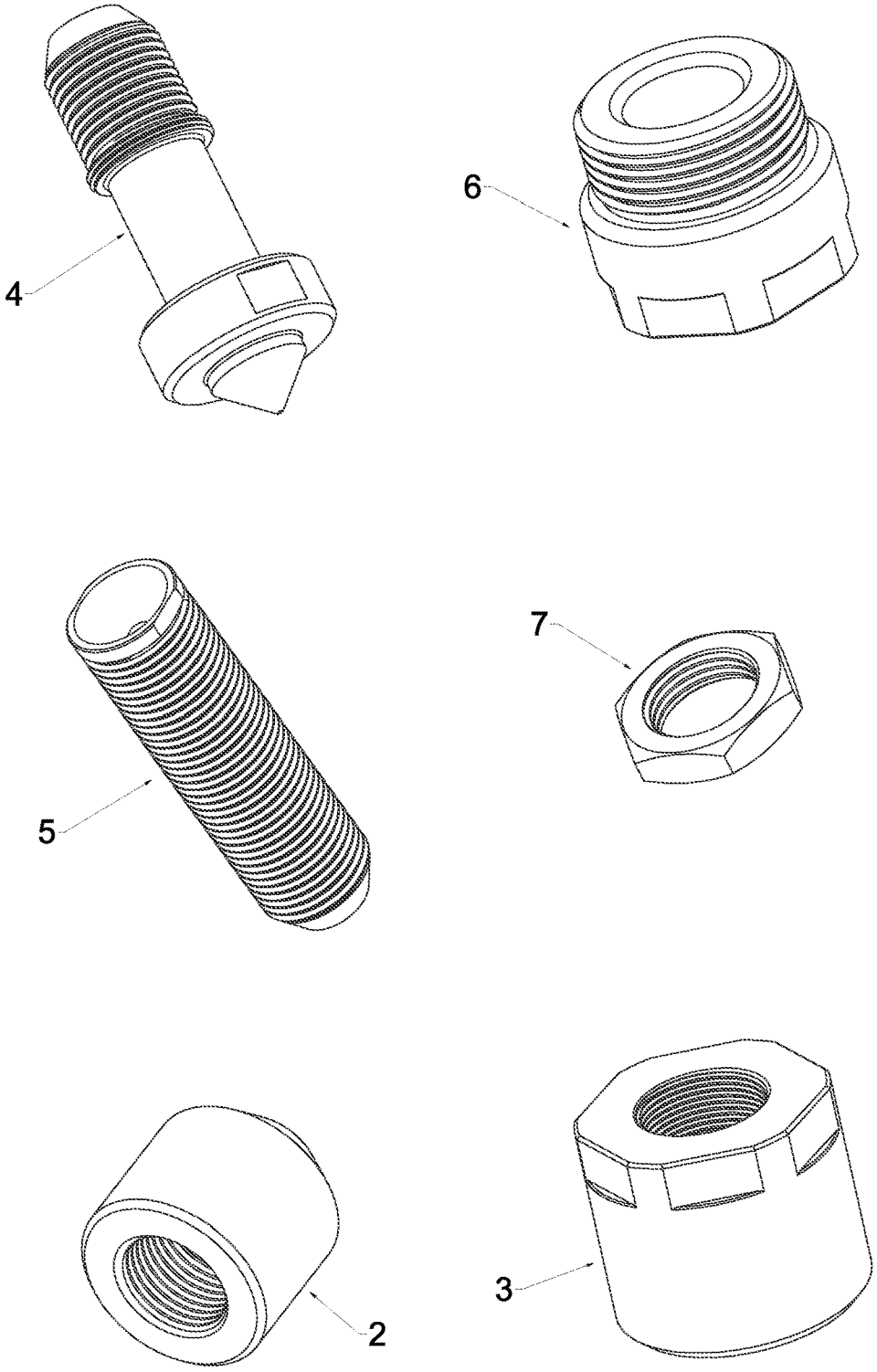
FIG. 14 shows details of individual components of the invention.

FIG. 14 is a clearer view of each of the individual components namely, internally threaded socket 2, enclosing coupler member 3, seating stud 4, threaded post 5, adjusting coupler member 6, and lock nut 7.

Figure 15:
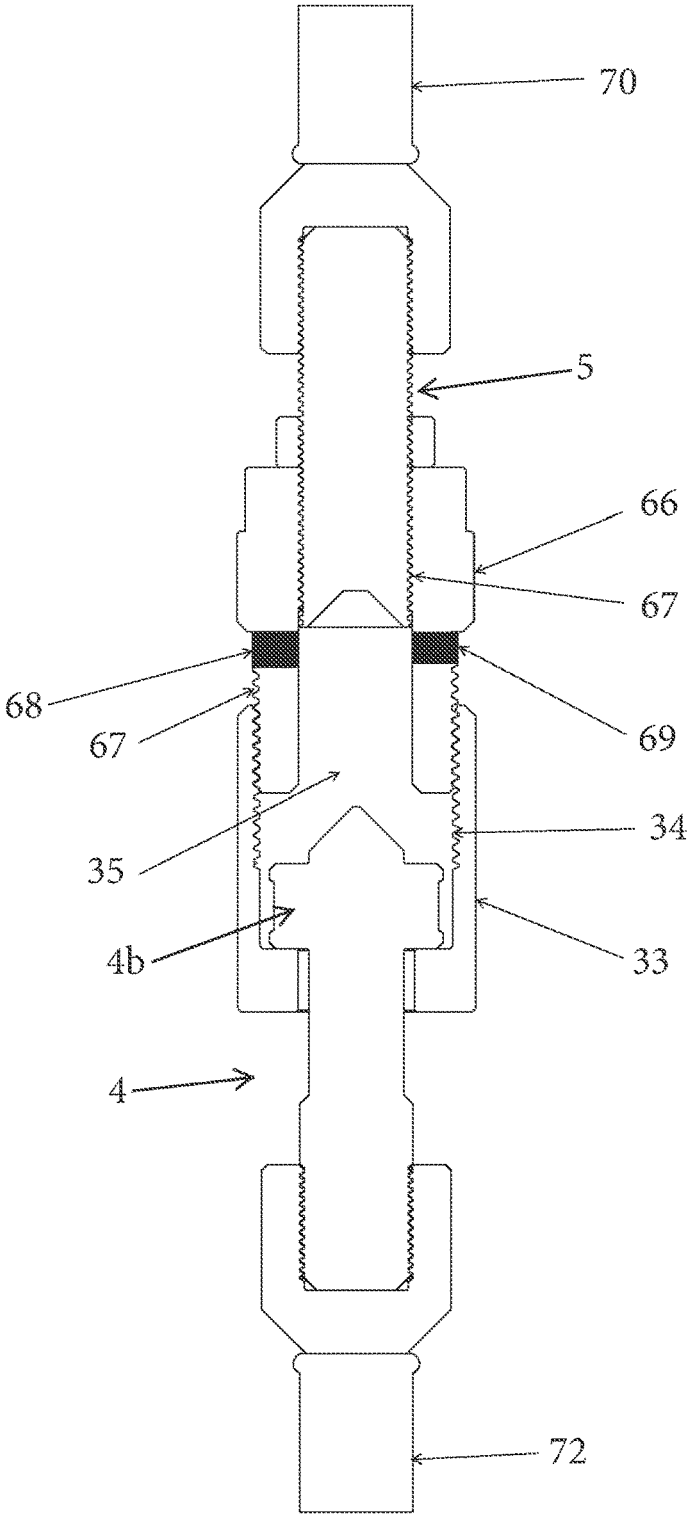
FIG. 15 shows modifications to the coupler assembly which enables its use as a tensioning mechanism.

In reference to FIG. 15, with modifications to the adjusting and enclosing coupler members, the present coupler assembly can also be used as a tensioning coupler.

Adjusting coupler member 66 has been lengthened to provide additional thread 67 and enclosing coupler member 33 has also been lengthened to provide additional thread 34. With this additional length and thread, it is now possible to use the adjustable coupler assembly to draw the two opposing bars 70, 72 toward each other and to put them in tension.

In operation, end wall 33*a* of enclosing coupler member 33 engages seating head 4*b* before inner coupler member 66 contacts seating head 4*b*. Continued screwing together of the adjusting and enclosing coupler members 66, 33 thereby draws the opposing rebar 70, 72 into tension.

Should this modified coupler be required to act in both tension and compression, a flowable, hard-setting material, such as a cementitious grout or epoxy, can be injected into internal void 35 that is created between adjusting coupler member 66 and enclosing coupler member 33 after the coupler members have been assembled. The flowable, hard-setting material can be injected through a feed hole 68 in the adjusting coupler member 66. A bleed hole 69 at the same level as feed hole 68 in adjusting coupler member 66 allows air to escape as the flowable, hard-setting material is injected into void 35. Both feed hole 68 and bleed hole 69 can be internally threaded to allow a threaded bung to be inserted to prevent any loss of the flowable, hard-setting material after it has been injected into the void. The internally threaded feed hole 68 may also be used to secure a threaded end of an injection apparatus when injecting the flowable, hard-setting material. After the flowable, hard-setting material has set to the required strength, this modified version of the adjustable coupler assembly will perform equally in transferring both compressive and tensile forces to opposite rebar 70, 72.

It will of course be realised that while the foregoing has been given by way of illustrative example of this invention, all such and other modifications and variations thereto as would be apparent to persons skilled in the art are deemed to fall within the broad scope and ambit of this invention as is herein set forth.

Additionally, throughout the specification it should be appreciated that the terms "comprising" and "containing" shall be understood to have a broad meaning similar to the term "including" and will be understood to imply the inclusion of a stated integer or step or group of integers or steps but not the exclusion of any other integer or step or group of integers or steps. This definition also applies to variations on the terms "comprising" and "containing" such as "comprise", "comprises", "contain" and "contains".

Moreover, the terms, 'concrete structural elements', 'concrete structures' and 'building structures' is understood to include concrete posts, columns, walls, floors, beams, other structures as well as steel beams, girders, posts, columns or other steel building components. Where reference is made to studs or posts, they equally apply to reinforcement bars or rods projecting from the structures as herein described. In the specific examples provided, the term, 'threaded' stud or post is interchangeable with reinforcement bars with an external thread. The term, 'screw jack' or 'screw jacking' are terms of the art referring to the lifting of the concrete structures by means of a lifter or jack utilising a threaded screw mechanism to impart lifting force.

The invention claimed is:

1. A coupler for joining opposing structural elements during construction comprising:

a threaded post adapted to be attached to a first structural element;

a one-piece, non-rotating seating stud comprising a shank including an integral seating head with a centring protrusion, the seating stud adapted to be attached to a corresponding opposite second structural element;

an adjusting coupler member having an inner threaded and an outer threaded wall and an end wall, the end wall complementarily configured to receive the centring protrusion;

the adjusting coupler member adapted to be screwed onto the threaded post so the end wall can be rotated against the one-piece, non-rotating seating stud, wherein the end wall on engaging the protrusion, assists to align the opposing first and second structural elements;

an enclosing coupler member having an inner threaded wall and an end wall aperture;

the enclosing coupler member adapted to be screwed onto the adjusting coupler member with the shank of the seating stud passing through the aperture;

the adjusting coupler member adapted to be screwed on the threaded post to engage and apply a pushing force against the seating head wherein the position of the first structural element to the second structural element can be adjusted, and wherein on achieving the desired final position, the enclosing coupler member can be screwed onto the adjusting coupler member to enclose and lock the seating head against the adjusting coupler.

2. The coupler of claim 1 wherein the seating stud is of a unitary or one piece construction and the seating head comprises a cylindrical boss with the centring protrusion located at the centre of its upper surface.

3. The coupler of claim 1 wherein the shank of the seating stud has a neck of a reduced size to provide increased sideways movement or lateral tolerance when located in the aperture of the enclosing coupler member.

4. The coupler of claim 1 wherein the centring protrusion of the seating head is of a conical, frusta conical or tapered configuration.

5. The coupler of claim 1 wherein the end wall of the adjusting coupler member adapted to receive the protrusion comprises an indentation or aperture which on fully engaging the protrusion there is a gap between the protrusion and the indentation or aperture of at least three millimetres in width.

6. The coupler of claim 1 wherein the end wall of the adjusting coupler member adapted to receive the protrusion comprises an indentation or aperture which on fully engaging the protrusion there is a gap between the protrusion and the indentation or aperture of less than three millimetres in width.

7. The coupler of claim 1 wherein the adjusting and enclosing couplers have facets or flats machined on an external face for the application of one or more spanners to turn and to tighten the adjusting and outer couplers together.

8. The coupler of claim 1 wherein the threaded post has an enlarged, un-threaded portion at one end as a safety feature to prevent the adjusting coupler member from being wound past its threaded engagement with the threaded post.

9. The coupler of claim 1 wherein the threaded post has an indentation or aperture at one end to afford the centring protrusion more vertical adjustment space and/or to reduce the overall length of the assembled coupler.

10. The coupler of claim 1 wherein there is a lock nut on the threaded post to be tightened against the adjusting coupler member to lock and confine overall slippage or elongation of the assembled coupler when under tensile or compressive load.

11. The coupler of claim 1 wherein a flowable, hard-setting filler, cementitious grout or epoxy, is injected into an internal void internal void formed on screwing together the adjusting and enclosing coupler members.

12. The coupler of claim 1 wherein there is a feed-hole in the adjusting coupler member for the injection of a filler.

13. The coupler of claim 1 wherein there is a bleed hole in the adjusting coupler to allow air to escape.

14. The coupler of claim 1 wherein the shank of the seating stud and enclosing coupler have complementary threaded portions to temporarily hold the enclosing coupler out of the way while the adjusting coupler engages the seating head prior to achieving the desired final position and the enclosing coupler member is screwed onto the adjusting coupler member to couple the first and second structural members.

15. The coupler of claim 1 modified for use as a tensioning coupler, the modifications including:

the adjusting coupler member lengthened to provide additional threads on its inner and outer walls;

the enclosing coupler member lengthened to provide additional thread on its inner wall;

wherein on assembly, the elongated threaded walls of both coupler members enables the end wall of the enclosing coupler to engage the seating head before the adjusting coupler member contacts the seating head, and wherein continued screwing together of the adjusting and enclosing coupler members draws together the opposing first and second structural members under tension.

16. A method of adjusting the position of concrete building structures located above one another through first and second structural elements using the coupler as claimed in claim 1 including the steps of:

a) attaching the threaded posts with adjusting coupler members screwed on, to the first concrete element;

b) attaching the seating studs passed through the enclosing coupler members to the corresponding opposite second concrete element;

c) screwing the enclosing coupler members onto the complementary threaded portions of the seating studs to temporarily hold the enclosing couplers out of the way;

d) screwing the adjusting coupler members on the posts to engage the seating heads to co axially align and apply a lifting or pushing force to adjust the position of the first and second concrete elements with respect to one another;

e) on completion of adjustment, screwing the enclosing coupler members on the adjusting coupler members to enclose and lock the seating heads and couple the rebar;

f) tightening any lock nuts to further secure individual components of the coupler assemblies;

g) optionally filling any voids in the coupler assemblies with filler, before h) permanently embedding the coupler assemblies in concrete.

17. A coupler for joining opposing structural elements during construction comprising:

a post adapted to be attached to a first structural element;

a one-piece seating stud comprising a shank including an integral seating head, the seating stud adapted to be attached to a corresponding opposite second structural element;

an adjusting coupler member having an inner threaded and an outer threaded wall and an end wall;

the adjusting coupler member associated with the post so the end wall can be rotated against the one-piece, seating stud, an enclosing coupler member having an inner threaded wall and an end wall aperture; the enclosing coupler member adapted to be screwed onto the adjusting coupler member with the shank of the seating stud passing through the aperture;

the adjusting coupler member adapted to be screwed on the post to engage and apply a pushing force against the seating head, wherein the position of the first structural element to the second structural element can be adjusted, and wherein on achieving the desired final position, the enclosing coupler member can be screwed onto the adjusting coupler member to enclose and lock the seating head against the adjusting coupler.

18. The coupler of claim 1 wherein the adjusting and enclosing couplers are embedded in concrete.

19. The coupler of claim 17 wherein the adjusting and enclosing couplers are embedded in concrete.

* * * * *